US008007191B2

(12) United States Patent
Gueret

(10) Patent No.: US 8,007,191 B2
(45) Date of Patent: Aug. 30, 2011

(54) PACKAGING AND APPLICATOR DEVICE FOR A COMPOSITION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1127 days.

(21) Appl. No.: 11/398,655

(22) Filed: Apr. 6, 2006

(65) Prior Publication Data

US 2006/0233588 A1 Oct. 19, 2006

Related U.S. Application Data

(60) Provisional application No. 60/675,891, filed on Apr. 29, 2005.

(30) Foreign Application Priority Data

Apr. 19, 2005 (FR) ..... 05 50995

(51) Int. Cl.
*A46B 11/00* (2006.01)

(52) U.S. Cl. ..... 401/129; 401/126

(58) Field of Classification Search ..... 401/5, 68, 401/71, 75, 77–78, 99, 102, 110, 115–117, 401/123, 126, 171–175, 200, 245, 269, 277–278, 401/280–282, 129

See application file for complete search history.

(56) References Cited

U.S. PATENT DOCUMENTS

| | | | | |
|---|---|---|---|---|
| 1,480,449 | A * | 1/1924 | Kendall | 401/78 |
| 2,630,215 | A * | 3/1953 | Lynn | 401/78 |
| 3,309,728 | A * | 3/1967 | Seaver | 15/184 |
| 3,817,636 | A | 6/1974 | Ritzenhoff | |
| 4,194,848 | A | 3/1980 | Kingsford | |
| 4,241,743 | A | 12/1980 | Schnabel et al. | |
| 4,261,376 | A | 4/1981 | Kingsford | |
| 4,332,494 | A | 6/1982 | Kingsford | |
| 4,333,928 | A | 6/1982 | Neef et al. | |
| 4,407,311 | A | 10/1983 | Gueret | |
| 4,609,300 | A | 9/1986 | Robert | |
| 4,628,950 | A | 12/1986 | Bitzer | |
| 4,705,053 | A | 11/1987 | Goncalves | |

(Continued)

FOREIGN PATENT DOCUMENTS

CN 1374057 A 10/2002

(Continued)

OTHER PUBLICATIONS

English Translation of JP 58-136014.*

(Continued)

*Primary Examiner* — David J Walczak
(74) *Attorney, Agent, or Firm* — Oliff & Berridge, PLC

(57) ABSTRACT

A packaging and/or applicator device may include: a first element including an axis and at least one slot extending almost perpendicularly to the axis, and a second element that is engaged, at least in part, inside the first element, and that is capable of turning relative to the first element about the axis. The second element may also be capable of being axially displaced in the first element. The second element may include at least one lug that is engaged in the slot and that is visible from an outside of the device. The slot and the lug may be configured in such a manner that displacement of the lug in the slot while the first and second elements are turning relative to each other causes the two elements to be displaced axially relative to each other.

41 Claims, 4 Drawing Sheets

U.S. PATENT DOCUMENTS

| | | | | |
|---|---|---|---|---|
| 4,750,501 | A * | 6/1988 | Ackermann et al. | 132/318 |
| 4,770,556 | A * | 9/1988 | Ackermann et al. | 401/69 |
| 4,984,919 | A * | 1/1991 | Hultgren | 401/78 |
| 5,743,279 | A | 4/1998 | Gueret | |
| 5,746,530 | A * | 5/1998 | Oota | 401/88 |
| 5,918,994 | A | 7/1999 | Gueret | |
| 6,024,507 | A * | 2/2000 | Joulia | 401/4 |
| 6,270,273 | B1 | 8/2001 | Ohba | |
| 6,343,607 | B1 | 2/2002 | Gueret | |
| 6,371,129 | B1 * | 4/2002 | Le Bras-Brown et al. | 132/218 |
| 6,412,496 | B1 | 7/2002 | Gueret | |
| 6,503,487 | B1 | 1/2003 | Ohba | |
| 6,539,950 | B1 | 4/2003 | Gueret | |
| 6,546,937 | B2 | 4/2003 | Gueret | |
| 6,581,610 | B1 | 6/2003 | Gueret | |
| 6,655,390 | B2 | 12/2003 | Gueret | |
| 6,662,810 | B2 | 12/2003 | Gueret | |
| 6,675,814 | B2 | 1/2004 | Gueret | |
| 6,676,320 | B1 | 1/2004 | Wainer | |
| 6,814,084 | B2 | 11/2004 | Gueret | |
| 6,866,046 | B2 | 3/2005 | Gueret | |
| 2001/0009629 | A1 | 7/2001 | Gueret | |
| 2002/0011251 | A1 | 1/2002 | Gueret | |
| 2002/0124860 | A1 | 9/2002 | Gueret | |
| 2002/0139385 | A1 | 10/2002 | Gueret | |
| 2003/0089379 | A1 | 5/2003 | Gueret | |
| 2003/0178043 | A1 | 9/2003 | Gueret | |
| 2004/0134507 | A1 | 7/2004 | Gueret | |
| 2004/0226573 | A1 | 11/2004 | Gueret | |
| 2004/0240926 | A1 | 12/2004 | Gueret | |

FOREIGN PATENT DOCUMENTS

| | | | |
|---|---|---|---|
| DE | 3240151 | A1 | 5/1984 |
| EP | 0 219 138 | A2 | 4/1987 |
| EP | 0 611 170 | A1 | 8/1994 |
| EP | 1 060 686 | A1 | 12/2000 |
| FR | 2 198 713 | | 4/1974 |
| FR | 2 515 941 | | 5/1983 |
| FR | 2 563 712 | | 11/1985 |
| FR | 2 580 479 | | 10/1986 |
| FR | 2 605 198 | | 4/1988 |
| FR | 2 738 125 | | 3/1997 |
| JP | U-58-136014 | | 9/1983 |
| JP | U-61-20974 | | 6/1986 |
| JP | U-01-22571 | | 7/1989 |
| JP | A 08-228829 | | 9/1996 |
| JP | A 8-289815 | | 11/1996 |
| JP | A 10-009128 | | 1/1998 |
| JP | A 10-117840 | | 5/1998 |
| JP | A 11-004714 | | 1/1999 |
| JP | A 11-244043 | | 9/1999 |
| JP | A 2000-037227 | | 2/2000 |
| JP | A 2000-066642 | | 3/2000 |
| JP | A 2001-000239 | | 1/2001 |
| JP | A 2001-061545 | | 3/2001 |
| JP | A 2001-061548 | | 3/2001 |
| JP | A 2001-327326 | | 11/2001 |
| WO | WO 98/00045 | | 1/1998 |

OTHER PUBLICATIONS

Partial English-language translation of Japanese Office Action dated Mar. 10, 2009.

Mar. 10, 2010 Office Action issued in Japanese Application No. 2006-115426 (with translation).

English translation of Chinese Office Action; Sep. 19, 2008, pp. 1-8.

Sep. 22, 2010 Office Action issued in U.S. Appl. No. 11/544,807.

Apr. 19, 2010 Office Action issued in U.S. Appl. No. 11/544,807.

* cited by examiner

PACKAGING AND APPLICATOR DEVICE FOR A COMPOSITION

CROSS-REFERENCE TO RELATED APPLICATIONS

This non-provisional application claims the benefit of French Application No. 05 50995 filed on Apr. 19, 2005 and U.S. Provisional application Ser. No. 60/675,891 filed on Apr. 29, 2005, the entire disclosures of which are incorporated herein by reference.

The include invention relates to packaging and applicator devices for a fluid composition, for example, a makeup composition for skin, lips, hair, or nails, for example, mascara.

Amongst other things, exemplary embodiments of the invention may apply to a packaging and applicator device that includes a wiper member, and means for acting on the wiper member to modify an inside section thereof so that an applicator passing therethrough is wiped to a greater or lesser extent.

BACKGROUND

For example, such devices are known in French patent application FR 2 515 941 and U.S. Pat. No. 4,194,948.

In French patent application FR 2 515 941, the receptacle includes an externally-threaded neck on which there is screwed a ring that may compress, to a greater or lesser extent, a wiper member into an hourglass shape, thereby modifying an inside diameter thereof. The closed device may be sealed by compressing the wiper member fully against a stem of an applicator.

U.S. Pat. No. 4,194,848 describes a device that includes a control ring that is screwed in an insert located in the neck of a receptacle.

SUMMARY

There exists a need to benefit from a device that makes it possible to act on a wiper member, a flow reducer, or a shutter, for example, that has components that are relatively simple to manufacture and to assemble, and/or that is reliable in operation and easy to use.

Exemplary embodiments of the include invention make it possible to satisfy such needs.

Exemplary embodiments of the invention include a packaging and/or applicator device comprising: a first element including an axis, which may be a longitudinal axis, and including at least one slot extending not entirely perpendicularly to the axis; and a second element that is engaged, at least in part, inside the first element, and that is configured to turn relative to the first element about the axis, and that is also configured to be axially displaced in the first element, the second element including at least one lug that is engaged in the slot, the lug being visible from an outside of the device; the slot and the lug being configured in such a manner that displacement of the lug in the slot while the first and second elements are turning relative to each other causes the two elements to be displaced axially relative to each other.

In exemplary embodiments, the lug may advantageously perform one or more of the following functions: serve as an indicator informing a user about a relative position of the first and second elements; retain the second element axially in the first element; and transform a turning movement of the second element into an axial displacement of the second element relative to the first element.

Such features may result in a device that is of relatively simple structure and this is practical to use.

In exemplary embodiments, there need only be one lug, which may be of any shape, for example, being of cross-section that is circular or otherwise and/or comprising one or more parts.

In exemplary embodiments, an outside surface of the device may include at least one visible marker that is associated with a particular relative position of the first and second elements, for example, a plurality of markers corresponding to different positions of the lug in the slot, with each marker comprising at least one alpha-numeric character or a pictogram, for example.

For example, the slot may extend angularly about the axis over less than 180°, for example, over about 120°.

In exemplary embodiments, the slot may include at least one edge that is smooth or notched. Where appropriate or desired, the at least one notch may make it easier to position the second element relative to the first element in at least one predefined position.

In exemplary embodiments, the existence of at least one notch may also form at least one hard point that may be felt by the user as the lug passes over the notch, and, where appropriate or desired, may be accompanied by emission of a click.

In exemplary embodiments, the existence of at least one notch may also make it easier to hold the lug in a predefined position while the device is being transported, for example, in a handbag.

In exemplary embodiments, the slot may include an angle of inclination relative to the axis that is selected in such a manner that an axial stroke of the second element in the first element, between extreme positions of the lug in the slot, lies in a range of about 1 millimeter (mm) to about 10 mm, for example, in a range of about 1 mm to about 8 mm, for example, even in a range of about 2 mm to about 5 mm.

In exemplary embodiments, the lug may include a length that is not less than a thickness of a wall of the first element in which the slot is formed. This may improve retention of the second element in the first element and/or visibility of the lug.

In exemplary embodiments, the lug may include a length that is less than a thickness of a wall of the first element in which the slot is formed. This may make it easier to put the lug into place.

In exemplary embodiments, the first and second elements may be configured to enable the lug to be inserted into the slot by elastically deforming at least one of the first and second elements, while the second element is being displaced inside the first element.

In exemplary embodiments, an inside surface of the first element may include at least one groove that makes it easier to displace the lug between an end of the first element, via which the second element is inserted, and the slot. For example, the groove may open to the end of the first element.

In exemplary embodiments, the lug may include a rounded or beveled free end. This may improve an appearance thereof and/or make it easier to put the lug into place in the slot.

In exemplary embodiments, the first element may be made as a single part by molding a plastics material. The same may apply for the second element.

In exemplary embodiments, the second element may include an end portion that extends permanently from the first element. The end portion may include an outer skirt that may be fluted or embossed, for example, so as to make it easier for the user to turn.

In exemplary embodiments, the second element may include a body that is closed at one end. In embodiments in which the end portion includes an outer skirt, the end portion may be configured in such a manner as to extend around a bottom of the body.

In exemplary embodiments, the body may contain a composition, for example, a cosmetic or a skin care product, for example, mascara.

In exemplary embodiments, the device may include an applicator for applying a composition that is contained in the device. The applicator may be fastened onto the first element, for example.

For example, the applicator may be fastened in a removable manner onto the first element so that the applicator may be removed from the device during application, and then put back into the device for loading with composition.

In exemplary embodiments, the applicator may include an applicator element that is configured to be housed in the second element when the applicator is in place.

In exemplary embodiments, the applicator may include a handle that is configured to be fastened onto the first element, for example, by screw-fastening.

In exemplary embodiments, the applicator element may be connected to the handle by a stem, which, where appropriate or desired, may be made integrally, i.e., monolithically, with the handle by molding a plastics material. The stem may also be provided at one end with an endpiece that is engaged in the handle.

In exemplary embodiments, the device may include a deformable element that is disposed in such a manner as to be deformed to a greater or lesser extent depending on a relative position of the first and second elements. The deformable element may comprise a fitted insert, or may be made integrally, i.e., monolithically, with one of the first and second elements.

For example, the deformable element may comprise a wiper member that is configured to wipe the applicator, at least in part, while the applicator is being removed.

For example, the deformable element may be disposed on one of the first and second elements, with the deformable element being fastened onto the second element, for example, and the deformable element may be deformed by the other element, depending on the relative axial position of the two elements.

In exemplary embodiments, the deformable element may be configured to be deformed in elongation or in compression. The deformable element may be configured to be deformed by spreading apart.

For deformation in elongation, in exemplary embodiments in which the deformable element comprises a wiper member, the deformable element may include, for example, a central portion that is provided with a transverse wall, for example, an end wall, including an opening therethrough, and the first element may include an internal extension that bears, to a greater or lesser extent, against the end wall, depending on the relative position of the first and second elements, thereby modifying a shape of the opening, for example, by widening the opening to a greater or lesser extent.

For deformation in compression, the elastically deformable element may comprise an elastically compressible material such as a foam, for example.

In exemplary embodiments, the elastically compressible material may include a hardness that depends on a degree of compression thereof. This may enable the user to modify wiping characteristics, for example.

At least in exemplary embodiments in which the deformable element comprises a wiper member, the deformable element may include a rim that co-operates with a central portion to define an annular groove in which the second element is engaged.

In exemplary embodiments, the transverse wall may include at least one slot that makes it easier to deform the wiper member by pressing an extension of the first element against the wiper member. For example, the transverse wall may include a plurality of substantially radial slots.

In exemplary embodiments, the internal extension of the first element acting on the deformable element may be made integrally, i.e., monolithically, with a remainder of the first element by molding a plastics material. The internal extension may include a tubular shape. The internal extension may also include a wiping function, where appropriate or desired.

In exemplary embodiments, the deformable element may comprise a plurality of tongues that are integrally, i.e., monolithically, molded with one of the first and second elements, and the other one of the first and second elements may include a surface against which the tongues may come to bear as a function of the relative axial position of the first and second elements.

In exemplary embodiments, the surface may be disposed in such a manner that the tongues flex to a greater or lesser extent depending on the relative axial position of the first and second elements.

In exemplary embodiments, the tongues define an opening for wiping the applicator element, and the opening may thus include a dimension that the user may vary by turning the first element relative to the second element. For example, the surface against which the tongues bear may be cone-shaped, converging toward an inside of the receptacle.

In exemplary embodiments, the first element may comprise a generally cylindrical outside wall in which the slot is formed. The outside wall may include substantially a same outside diameter as the end portion of the second element, for example.

In exemplary embodiments, the applicator may include a stem that is provided with a constriction in a region of the stem that becomes positioned in registration with the wiper member when the device is closed. The constriction may extend over a length that is not less than a maximum displacement stroke of the second element relative to the first element. This may make it possible to avoid or to reduce stresses exerted by the stem on the wiper member when the applicator is in place, regardless of an angular orientation of the first element relative to the second element.

Also, in exemplary embodiments, the elastically deformable member need not serve as a wiper member, but may serve as a closure member and/or as a flow-rate control member by being configured to obstruct, at least in part, communication between the outside and the inside of the body of the second element in a first relative position of the first and second elements, and to obstruct, to a lesser extent, the communication in a second relative position of the first and second elements, passage from one position to the other corresponding to the lug being displaced in the slot.

In exemplary embodiments, the first relative position may correspond to complete obstruction.

In other exemplary embodiments, the first relative position may correspond to incomplete obstruction.

For example, the applicator element may comprise a brush, for example, a brush comprising a twisted core, with bristles held between turns of the core. The applicator element may also be other than a brush. For example, the applicator element may comprise a flocked endpiece, a comb, a felt-tip, or a foam, or may comprise a brush that does not include a metal core.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
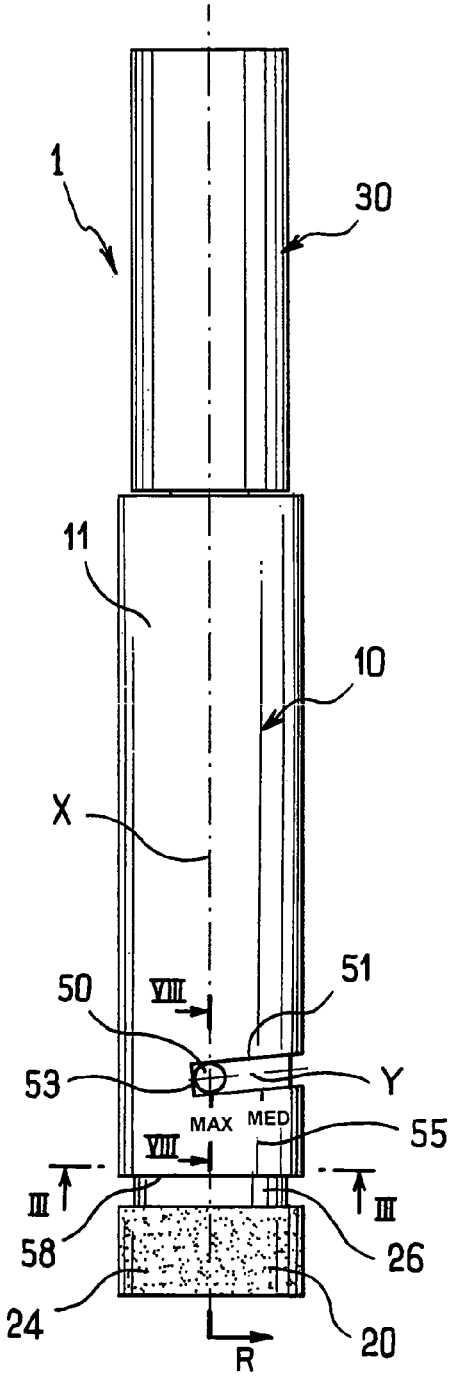
FIG. 1 is a diagram in elevation illustrating an exemplary embodiment of a device.
Figure 2:
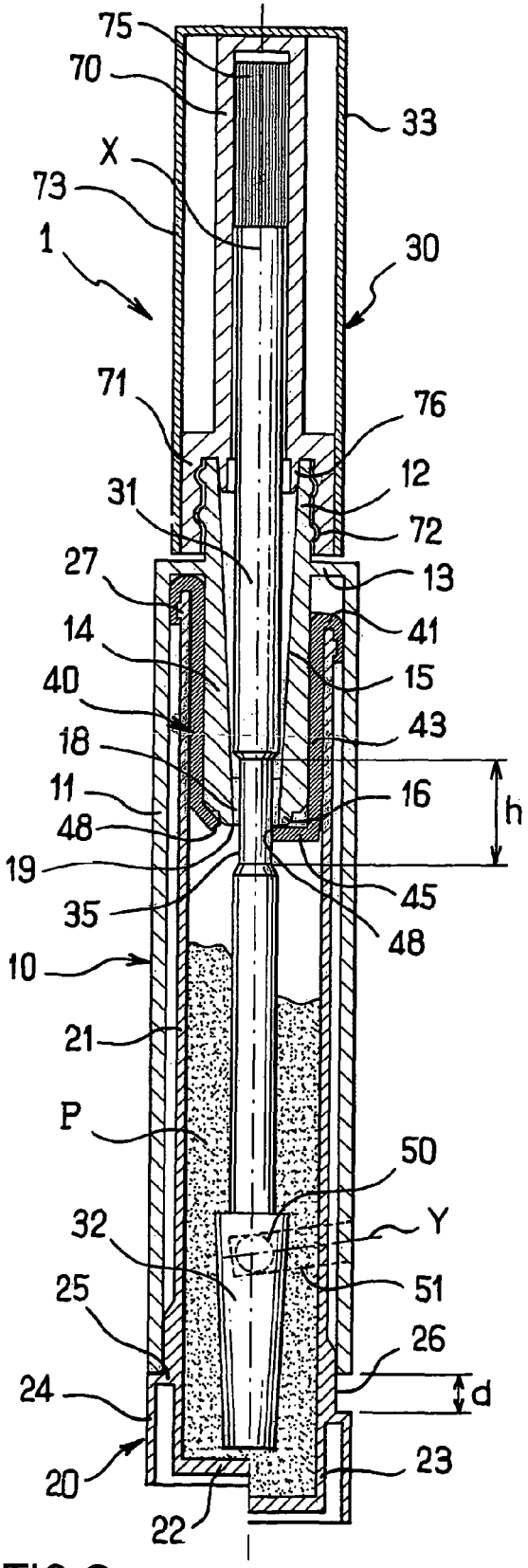
FIG. 2 combines two diagrammatic longitudinal half-sectional views of the device of FIG. 1, with the lug in the slot in two positions, respectively.

The exemplary device 1 illustrated in FIGS. 1 and 2 comprises a first element 10, and a second element 20 that is configured to be turned relative to the first element 10 about a longitudinal axis X of the device.

The device 1 may also comprise an applicator 30, which, in the exemplary embodiment, comprises a stem 31, of axis X, that is provided at one end with an applicator element 32, and at the other end with a handle 33.

As illustrated in FIG. 2, the first element 10 may comprise a generally cylindrical wall 11, of axis X, that is extended at a top portion thereof by a neck 12 that is connected at a bottom thereof to a transverse wall 13.

In the embodiment illustrated, the first element 10 may also comprise an internal extension 14 of tubular shape, defining an insertion cone 15 for the applicator member, converging toward an inside of the receptacle, and being provided at a bottom end thereof with an annular flange 16.

In the exemplary embodiment, the second element 20 may comprise a generally tubular body 21, of axis X, that is closed at a bottom end thereof by a bottom wall 22. A bottom portion 23 of the body 21 may be surrounded by an outer skirt 24 including an outside surface that is embossed with a grainy surface, as illustrated in FIG. 1. In other exemplary embodiments (not illustrated), the outer skirt 24 may be fluted.

A top of the skirt 24 may join the transverse wall 25 that is connected perpendicularly to the body 21. The wall of the body may be thicker above the transverse wall 25, so as to form a cylindrical guide surface 26 of outside diameter that matches an inside diameter of the bottom end of the wall 11. A height of the guide surface 26 may be sufficient for the surface 26 to remain substantially in contact with the inside surface of the wall 11, regardless of an angular position of the second element 20 relative to the first element 10.

The radially outer surface of the top portion of the body 21 may include an annular flange 27 onto which a wiper member 40 may be fastened. A top portion of the wiper member 40 may include an annular rim 41 that is configured to snap-fasten onto the flange 27. The rim 41 may be connected to a tubular skirt 43 that extends into an annular gap between the internal extension 14 and the top portion of the body 21.

A bottom portion of the wiper member 40 may include a transverse wall 45 through which a central orifice 46 passes, and a plurality of slots 47 that form tongues 48 therebetween.

Figure 14:
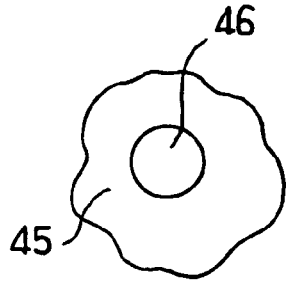
FIG. 14 is a view similar to FIG. 4 illustrating another exemplary embodiment.

In the exemplary embodiment illustrated in FIG. 14, the transverse wall 45 may include only one orifice 46 of circular cross-section passing therethrough, without the slots 47. Where appropriate or desired, this may make it possible for the wiper member to be in a leaktight contact with the stem 31 of the applicator, for example, during storage.

The body 21 may serve as a reservoir, and may contain a composition P, for example, mascara.

The second element 20 may be provided with a lug 50, and the first element 10 may include a slot 51 formed in the wall 11 and including a longitudinal axis Y that extends along a helical portion, for example, over an angular distance of about 120°, for example, about the axis X.

Figure 10:
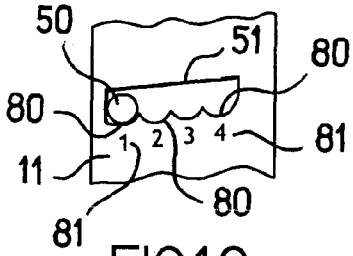
FIGS. 10 and 11 are fragmentary and diagrammatic front views of a fraction of the first element including the slot, illustrating two exemplary embodiments.
Figure 11:
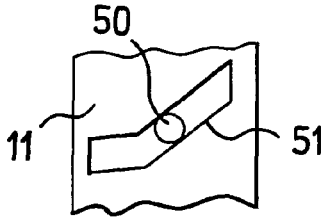

FIG. 11 illustrates the possibility of the slot 51 extending other than along a single helical portion. FIG. 10 illustrates the possibility of at least one of the edges of the slot 51 including notches 80. For example, at least one of the notches may be associated with a marker 81, such as a number or a letter, that is useful to a user.

For example, an angle of inclination of the slot 51 may allow a maximum stroke d, in the axial direction, that lies in a range of 2 mm to 3 mm when the lug 50 passes from one extreme position to the other, on turning the second element 20 relative to the first element 10.

Figure 5:
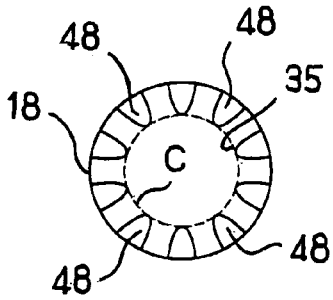
FIGS. 5 to 7 are views from above illustrating a shape of the wiper orifice through an insertion opening of the applicator element for different positions of the lug in the slot.

When the second element 20 is in a low abutment position corresponding to FIG. 1, for example, with the lug 50 coming to bear against the left-hand end 53 of the slot 51, the bottom end 19 of the internal extension 14 may not substantially deform the wall 45 of the wiper member 40, and the tongues 48 may extend maximally into the circular orifice 18, defined by the bottom end of the insertion cone 15, as illustrated in FIG. 5. Wiping is then at a maximum, and a load of composition on the applicator element is at a minimum.

As illustrated in FIG. 2, the stem 31 may advantageously include an annular constriction 35 including a diameter that substantially corresponds to a diameter of a circle C passing via vertices of the tongues 48, in the configuration illustrated in FIG. 5. Thus, the stem 31 may not exert stress, or may exert only a relatively small amount of stress, on the wiper member, thereby reducing a risk of the wiper member deforming permanently.

Figure 6:
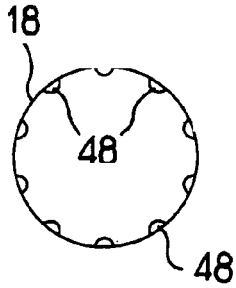
Figure 7:
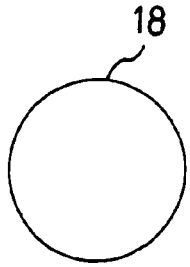

While the second element is being turned in a direction of arrow R in FIG. 1, the lug 50 is displaced in the slot 51, and rises relative to the first element 10. The internal extension 14 presses downward against the wall 45, and the tongues 48 move apart. The tongues thus project over a smaller distance into the orifice 18, as illustrated in FIG. 6. At the end of the turning stroke in the direction of arrow R, the lug 50 reaches a high abutment position corresponding to the left-hand half-section in FIG. 2, and the tongues 48 hardly project any more into the orifice 18, as illustrated in FIG. 7.

In the exemplary embodiment, the internal extension 14 may not pass through the transverse wall 45. In exemplary embodiments (not illustrated), an axial displacement stroke of the internal extension 14 may be long enough for the internal extension to pass right through the wiper member 40.

A degree to which the wiper member is to be deformed may be selected as a function of a desired result, for example, depending on whether or not it is desirable to conserve the wiping operation regardless of the position of the lug in the slot, or whether it is desirable, in a given position, to perform the wiping operation only on the edge of the internal extension.

For example, it is possible to include two positions corresponding to wiping on the elastically deformable wiper member and to wiping on the internal extension, respectively. In exemplary embodiments, it is also possible to include at least one position in which wiping does not take place, for example, by making the internal extension in such a manner that it cannot normally wipe the applicator element.

The constriction 35 may preferably extend over a height h that is greater than a maximum axial stroke d of the second element relative to the first element, such that, regardless of the position of the lug 50 in the slot 51, the constriction 35 always faces the ends of the tongues 48. In exemplary embodiments (not illustrated), the stem may not include a constriction.

Figure 3:
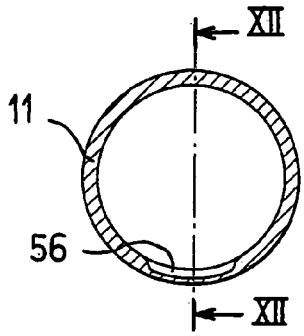
FIG. 3 is a cross-sectional view, taken along III-III in FIG. 1, illustrating an end portion of the first element.
Figure 4:
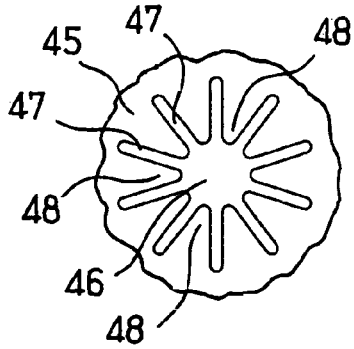
FIG. 4 is a diagrammatic and fragmentary front view of an end wall of the wiper member in isolation.

To assemble the device 1, the wiper member 40 may be secured to the second element 20, for example, then the second element may be inserted into the first element. To make it easier for the lug 50 to pass over the bottom portion 55 of the first element 10, the wall 11 of the first element may advantageously include a groove 56 in a radially inner surface thereof, the groove opening to the bottom end 58 of the wall 11, for example, as illustrated in FIG. 3.

Figure 12:
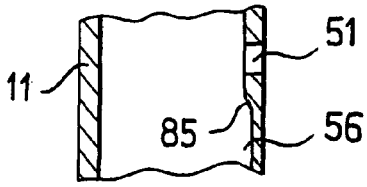
FIG. 12 is a fragmentary longitudinal sectional view, taken along XII-XII in FIG. 3.

A top of the groove 56 may optionally include a ramp 85 making it easier for the lug to pass, as illustrated in FIG. 12.

Figure 8:
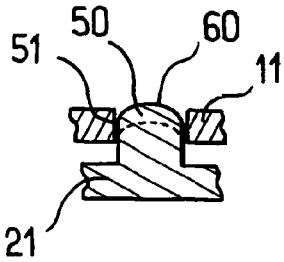
FIG. 8 is a diagrammatic and fragmentary cross-sectional view, taken along VIII-VIII in FIG. 1.

The lug 50 may include a rounded top end 60, as illustrated in FIG. 8, so as to make it easier to pass over the end portion 55.

Figure 9:
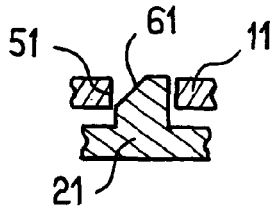
FIG. 9 is a view similar to FIG. 8 illustrating another exemplary embodiment of the lug.

In the exemplary embodiment illustrated in FIG. 9, the lug 50 may include a bevel 61.

The groove 56 may be positioned relative to the slot 51 in such a manner that the lug 50, after being displaced along the axis X in the groove 56, reaches a position that is adjacent to the end 53.

For example, a length of the lug 50 may enable the lug 50 to project a little from the slot 51, as illustrated in FIG. 8. In FIG. 8, a dashed line illustrates the possibility, in other exemplary embodiments, of the lug 50 including a shorter length, so as to remain set back from the outside surface of the second element.

The lug may optionally be colored so as to appear more clearly, and, in this event, may be made by bi-injecting material together with a remainder of the second element 20, for example.

For example, the stem 31 may be engaged in an internal cap 70 of the handle, the internal cap 70 being configured to include an internally-threaded assembly skirt 71 that is configured to be screwed onto an external thread 72 of the neck 12.

The assembly skirt 71 may support an external cap 73, for example, a metal cap.

A top end of the stem 31 may include fluting 75, enabling the stem 31 to be force-fitted in the internal cap 70.

As illustrated, the internal cap 70 may also include a sealing lip 76 that comes to bear on the radially inner surface of the neck 12, when the internal cap 70 is fully screwed on the neck 12. Naturally, the handle may be fastened in some other way onto the first element 10, for example, by friction or by snap-fastening.

Figure 13:
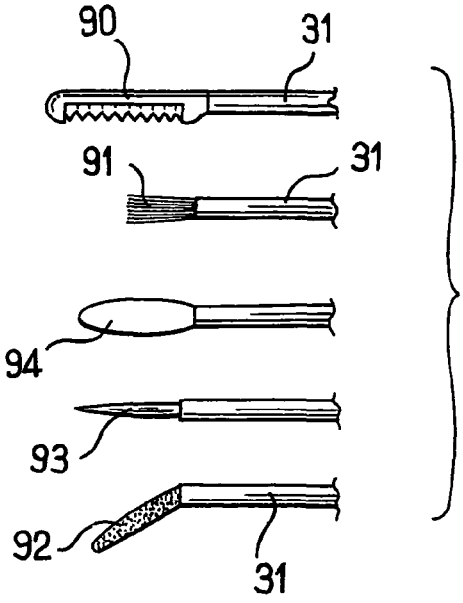
FIG. 13 illustrates various exemplary applicator elements.

The invention is not limited to a particular type of applicator element, and, for example, the applicator element may be other than a mascara brush, for example, a comb 90, an optionally flocked endpiece 92, for example, made of elastomer, a felt-tip 93, a foam 94, or a brush 91, as illustrated in FIG. 13. A greatest transverse dimension of the applicator element may be smaller than or greater than a diameter of the stem 31.

Figure 15:
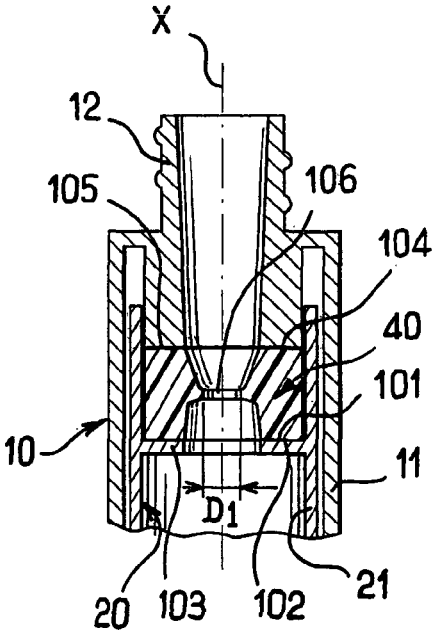
FIGS. 15 and 16 are diagrammatic and fragmentary longitudinal sectional views of another exemplary embodiment, illustrating two different relative positions of the first and second elements, respectively.
Figure 16:
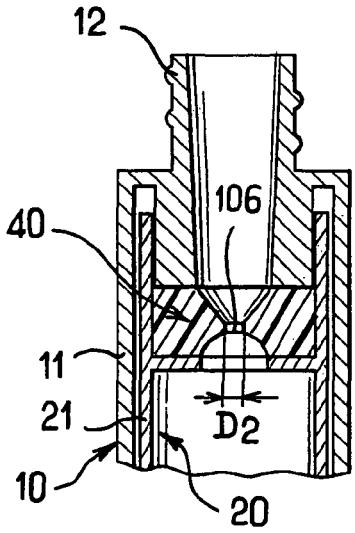

The wiper member may also be made in some other way, and, for example, need not work in elongation, but may work in compression, as illustrated in FIGS. 15 and 16.

In FIGS. 15 and 16, an exemplary device is illustrated in part, the device including a bottom portion (not illustrated) that is the same as the bottom portion of the exemplary device in FIGS. 1 and 2, for example, and including a top portion that is modified in such a manner as to house the wiper member 40 that is made of an elastically deformable material.

The wiper member 40 may rest via a bottom face 101 thereof against a shoulder 102 formed by an annular rib 103 of the body 21, for example, and bears via a top face 104 thereof against the bottom edge 105 of an internal extension of the first element 10.

When the second element 20 is in the configuration in which the second element 20 is least engaged in the first element 10, the wiper member 40 may be compressed only a little, such that the wiper member 40 forms a relatively large opening 106, that is of a first diameter $D_1$, for example.

Figure 17:
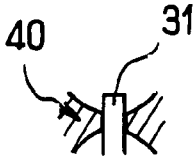
FIG. 17 illustrates an exemplary embodiment in which the wiper member is in a leaktight contact with the stem.

When the second element 20 is displaced angularly relative to the first element 10, in such a manner as to become engaged further in the first element 10, the wiper member 40 becomes more compressed between the first element 10 and the second element 20, and the diameter of the opening 106 becomes smaller, and passes to a second diameter $D_2$ that is smaller than $D_1$.

Where appropriate or desired, the wiper member 40 may be applied in leaktight manner against the stem 40 when the diameter of the opening 106 is small, as illustrated in FIG. 17.

The wiper member may also be replaced by a flow reducer, or indeed by a shutter, with the applicator being optionally included.

Figure 18:
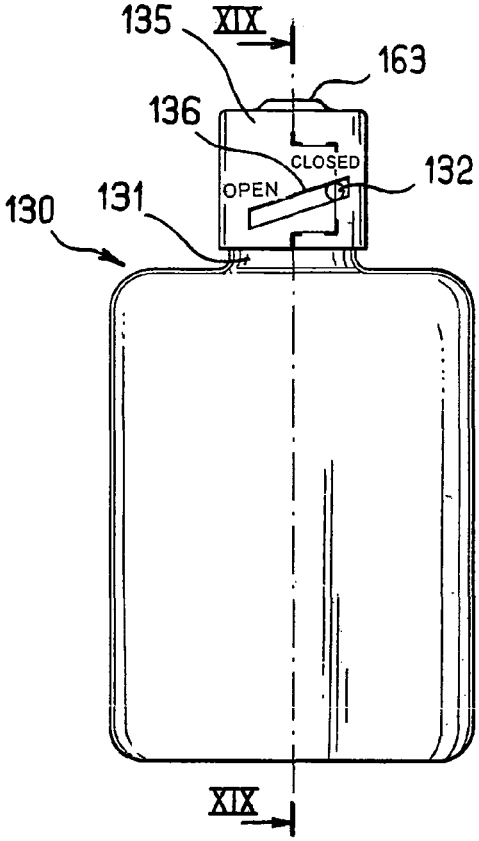
FIG. 18 is a view in elevation illustrating another exemplary embodiment.
Figure 19:
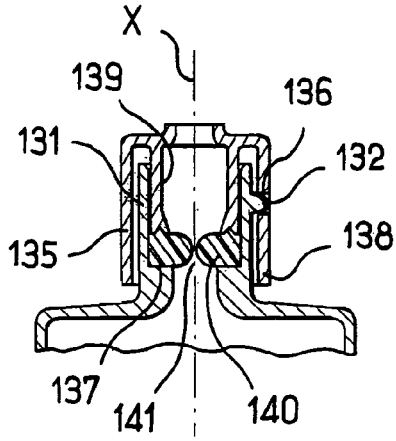
FIG. 19 is a diagrammatic and fragmentary longitudinal sectional view, taken along XIX-XIX in FIG. 18.

For example, FIGS. 18 and 19 illustrate an exemplary receptacle 130 that includes a neck 131 that is provided with a lug 132. The neck 131 may comprise a second element as described herein, the first element comprising a cap 135 that is engaged on the neck 131, and that is provided with a slot 136 in which the lug 132 may slide.

An elastically deformable member 140 may be disposed inside the neck 131, and may bear via a bottom face thereof against a shoulder 137 of the neck.

The cap 135 may include an outer skirt 138, and an internal extension 139 that is configured to bear against the elastically deformable member 140, at least when the lug 132 is in the closed or reduced-flow position, so as to compress the deformable member 140 axially. The deformable member may include an opening 141 passing therethrough, and the section of the opening depends on the degree of axial compression.

When the deformable member 140 comprises a flow reducer, the opening 141 may remain open, even when the lug 132 is in the extreme position, corresponding to the neck 131 being pushed as far as possible into the cap 135.

When the deformable member 140 comprises a shutter, as in the embodiment illustrated, the opening 141 may allow composition to pass therethrough only when the lug 132 has been displaced in the slot 136 toward the open position, and when the compression force that is exerted axially on the member 140 is reduced.

Figure 20:
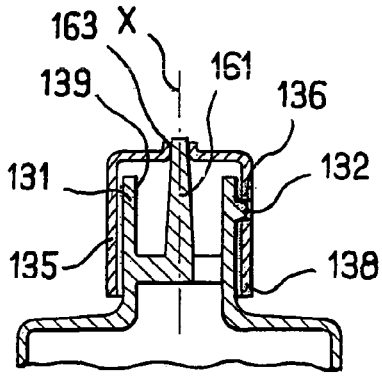
FIG. 20 is a sectional view similar to FIG. 19 illustrating another exemplary embodiment.

The device need not include a deformable member interposed between the first and second elements, but may include a shutter 161 carried by the neck 131 and configured to obstruct the dispenser orifice 163 of the cap 135 when the lug 132 is in an extreme position in the slot 136, as illustrated in FIG. 20.

Figure 21:
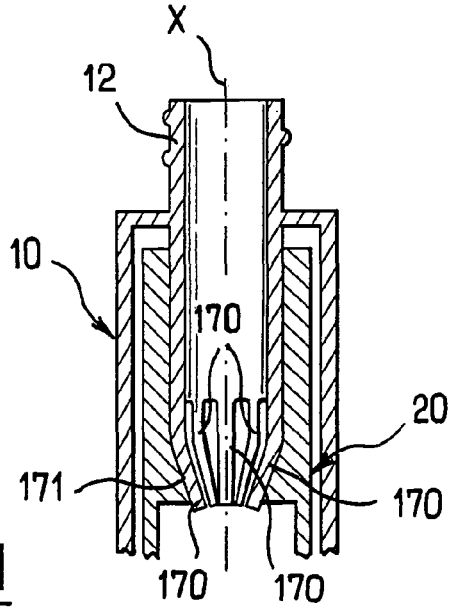
FIG. 21 is a fragmentary and diagrammatic longitudinal sectional view of another exemplary embodiment of the wiper member.

At least part of the wiper member may also be made integrally, i.e., monolithically, with one of the first and second elements, as illustrated in FIG. 21.

In this exemplary embodiment, the first element 10 may be made with an internal extension that is terminated by a plurality of flexible tongues 170 that are engaged in the second element, and that may come to bear against a surface 171 of the second element. For example, the surface 171 may be cone-shaped, converging toward the bottom of the receptacle.

Free ends of the tongues may define an opening through which the applicator element may pass, and the user may vary the diameter of the opening by modifying the axial position of the first element relative to the second element.

When the internal extension of the first element is pushed into the second element, the tongues are deflected radially inward, thereby decreasing the diameter of the wiper orifice.

When the first element rises, the tongues tend to move apart as a result of their own elasticity, and the diameter of the wiper orifice increases.

When the tongues have risen sufficiently, the diameter of the wiper orifice may be defined by the radially inner edge of the surface 171.

The invention is not limited to the embodiments described above.

For example, characteristics of the various embodiments described may be combined with one another in embodiments that are not illustrated.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The expression "comprising a" should be understood as being synonymous with "comprising at least one", unless specified to the contrary.

What is claimed is:

1. A packaging and/or applicator device comprising:

a first element including an axis and at least one slot extending not entirely perpendicularly to the axis over an angle smaller than 180 degrees; and a second element that is engaged, at least in part, inside the first element, and that is rotatable relative to the first element about the axis, and that is axially movable in the first element, the second element including at least one lug that is engaged in the slot and that is visible from an outside of the device, the at least one lug having a length that is less than a thickness of a wall of the first element in which the at least one slot is formed;

the slot and the lug being configured in such a manner that displacement of the lug in the slot while the first and second elements are turning relative to each other causes the first and second elements to be displaced axially relative to each other, the first and second elements being configured to enable the lug to be inserted into the slot by elastically deforming at least one of the first and second elements, while the second element is being displaced inside the first element.

2. The device according to claim 1, wherein there is only one lug.

3. The device according to claim 1, wherein an outside surface of the device includes at least one visible marker that is associated with a relative position of the first and second elements.

4. The device according to claim 1, wherein the slot includes a smooth edge.

5. The device according to claim 1, wherein the slot includes a notched edge.

6. The device according to claim 1, wherein the slot includes an angle of inclination, relative to the axis, such that an axial stroke of the second element in the first element, between extreme positions of the lug in the slot, lies in a range of about 1 mm to about 10 mm.

7. The device according to claim 1, wherein an inside surface of the first element includes at least one groove that facilitates displacement of the lug between an end of the first element, via which the second element is inserted, and the slot.

8. The device according to claim 7, wherein the groove opens to the end of the first element.

9. The device according to claim 1, wherein the lug includes a rounded free end.

10. The device according to claim 1, wherein the first element comprises a single molded part of a plastics material.

11. The device according to claim 1, wherein the second element comprises a single molded part of a plastics material.

12. The device according to claim 1, wherein the second element includes an end portion that permanently extends from the first element.

13. The device according to claim 12, wherein the end portion includes an outer skirt that is at least one of fluted and embossed.

14. The device according to claim 13, wherein the second element includes a body that is closed at one end, and wherein the outer skirt extends around a bottom of the body.

15. The device according to claim 1, wherein the second element includes a body that is closed at one end.

16. The device according to claim 1, further comprising a composition contained therein.

17. The device of claim 1, further comprising an applicator.

18. The device of claim 17, wherein the applicator is fastened in a removable manner onto the first element so that the applicator can be removed from the device during application, and then placed back into the device for loading with a composition.

19. The device according to claim 17, wherein the applicator includes an applicator element that is configured to be housed in the second element when the applicator is in place on the first element.

20. The device according to claim 19, wherein the applicator element comprises a brush.

21. The device according to claim 20, wherein the brush comprises a twisted metal core, with bristles held between turns of the core.

22. The device according to claim 19, wherein the applicator element comprises at least one of a flocked endpiece, a comb, a felt-tip and a foam.

23. The device according to claim 19, wherein the applicator includes a handle that is configured to be fastened onto the first element.

24. The device according to claim 19, wherein the applicator includes a handle that is configured to be fastened onto the first element, and wherein the applicator element is connected to the handle by a stem.

25. The device according to claim 1, further comprising a deformable element that is disposed in such a manner as to be deformed to a variable extent depending on a relative position of the first and second elements.

26. The device according to claim 25, wherein the deformable element comprises a wiper member that is configured to wipe an applicator, at least in part, while the applicator is being removed.

27. The device according to claim 26, wherein the deformable element is configured to be deformed by spreading apart.

28. The device according to claim 27, wherein the deformable element comprises a plurality of flexible tongues.

29. The device according to claim 26, further comprising an applicator that includes a stem with a constriction in a region of the stem that becomes positioned in registration with the wiper member when the device is closed.

30. The device according to claim 29, wherein the constriction extends over a length that is not less than a maximum displacement stroke of the second element relative to the first element.

31. The device according to claim 25, wherein the deformable element is fastened onto the second element.

32. The device according to claim 25, wherein the deformable element is configured to be deformed in elongation.

33. The device according to claim 25, wherein the deformable element is configured to be deformed in compression.

34. The device according to claim 25, wherein the deformable element includes a central portion that includes a transverse wall including an opening therethrough, and wherein the first element includes an internal extension that bears, to a variable extent, against the transverse wall, thereby modifying the shape of the opening.

35. The device according to claim 34, in which the transverse wall includes at least one slot.

36. The device according to claim 35, wherein the internal extension of the first element is made monolithically with a remainder of the first element by molding a plastics material.

37. The device according to claim 29, wherein the elastically deformable member comprises a closure member that is configured to close communication between an outside and an inside of a body of the second element in a first relative position of the first and second elements, and to open communication in a second relative position of the first and second elements, passage from one relative position to the other relative position corresponding to the displacement of the lug in the slot.

38. The device according to claim 29, wherein the elastically deformable member comprises a flow-rate control member that is configured to obstruct, in part, communication between an outside and an inside of a body of the second element in a first relative position of the first and second elements, and to obstruct, to a lesser extent, communication in a second relative position of the first and second elements, passage from one relative position to the other relative position corresponding to the displacement of the lug in the slot.

39. A packaging and/or applicator device comprising:

a first element including an axis and at least one slot extending not entirely perpendicularly to the axis over an angle smaller than 180 degrees; and a second element that is engaged, at least in part, inside the first element, and that is rotatable relative to the first element about the axis, and that is axially movable in the first element, the second element including at least one lug that is engaged in the slot and that is visible from an outside of the device and an end portion that permanently extends from the first element, wherein the end portion includes an outer skirt that is at least one of fluted and embossed;

the slot and the lug being configured in such a manner that displacement of the lug in the slot while the first and second elements are turning relative to each other causes the first and second elements to be displaced axially relative to each other, other.

40. The device according to claim 39, wherein the lug includes a length that is not less than a thickness of a wall of the first element in which the slot is formed.

41. The device of claim 39, further comprising an applicator.

* * * * *